United States Patent [19]

Payne

[11] 4,139,349

[45] Feb. 13, 1979

[54] FUEL COMPOSITIONS CONTAINING SYNERGISTIC MIXTURES OF IRON AND MANGANESE ANTIKNOCK COMPOUNDS

[75] Inventor: Donald H. Payne, Wilmington, Del.

[73] Assignee: E. I. Du Pont de Nemours & Co., Wilmington, Del.

[21] Appl. No.: 835,805

[22] Filed: Sep. 21, 1977

[51] Int. Cl.[2] ..... C10L 1/18

[52] U.S. Cl. ..... 44/68; 252/386

[58] Field of Search ..... 44/68; 252/386

[56] References Cited

U.S. PATENT DOCUMENTS 2,868,816 1/1959 Petree ..... 44/68

3,341,311 9/1967 Pedersen ..... 44/68

3,353,938 11/1967 Niedzielski ..... 44/68

*Primary Examiner*—Winston A. Douglas

*Assistant Examiner*—Y. Harris-Smith

*Attorney, Agent, or Firm*—James A. Costello

[57] ABSTRACT

Hydrocarbon fuel compositions consisting essentially of hydrocarbons boiling in the gasoline boiling range having dissolved therein a combination of dicyclopentadienyl iron and cyclopentadienyl manganese tricarbonyl compounds. Said iron and manganese compounds provide about 0.05 to 0.25 gram of total metal per gallon of fuel, of which metal 10% to 70% is iron and 30% to 90% is manganese.

9 Claims, 2 Drawing Figures

FUEL COMPOSITIONS CONTAINING SYNERGISTIC MIXTURES OF IRON AND MANGANESE ANTIKNOCK COMPOUNDS

BACKGROUND OF THE INVENTION

This invention concerns lead-free hydrocarbon fuel compositions comprising fuel and a synergistic combination of the antiknocks: dicyclopentadienyl iron and cyclopentadienyl manganese tricarbonyl.

Dicyclopentadienyl iron compounds and substituted dicyclopentadienyl iron compounds are known to be effective in improving the octane quality of gasolines. The manner of their preparation is known in the art; see, for example, U.S. Pat. Nos. 2,680,756, 2,804,468 and 3,341,311.

Cyclopentadienyl manganese tricarbonyl compounds and substituted cyclopentadienyl manganese tricarbonyl compounds are also known to be effective octane rating improvers in gasolines. The manner of their preparation is known; see, for example, U.S. Pat. Nos. 2,818,417, 2,868,816, and 3,127,351.

Binary mixtures of antiknock compounds are known, e.g., dicyclopentadienyl iron with methylcyclopentadienyl manganese tricarbonyl; see U.S. Pat. No. 3,353,938. The patent, however, leads away from the discovery embodied in the instant invention by disclosing merely that expected octane improvement is achieved at total metal concentrations of 0.3 gram per gallon of fuel. Although accurate, the teaching does not suggest that at lower total metal concentrations, i.e., 0.05 to 0.25, there is a synergistic increase in octane rating. The patent is primarily concerned with demonstrating synergism of certain iron and nickel compounds. Particular attention is directed to column 8, lines 4 to 13 of the patent.

SUMMARY OF THE INVENTION

This invention provides a lead-free fuel composition consisting essentially of hydrocarbons boiling in the gasoline boiling range of about 20° C. to 225° C., having dissolved therein a combination of iron and manganese antiknock compounds in amounts to provide about 0.05 to 0.25 gram of total metal per gallon of fuel, said combination consisting essentially of about (i) 10% to 70% of iron, by weight of total metal, provided by at least one member of the group dicyclopentadienyl iron and substituted dicyclopentadienyl iron in which the substituent consists of one or two alkyl radicals of 1 or 2 carbon atoms, and (ii) 30% to 90% of manganese, by weight of total metal, provided by at least one member of the group cyclopentadienyl manganese tricarbonyl and substituted cyclopentadienyl manganese tricarbonyl in which the substituent consists of one or two alkyl radicals of 1 or 2 carbon atoms.

Representative substituted dicyclopentadienyl iron compounds are cyclopentadienyl(methylcyclopentadienyl) iron, cyclopentadienyl(ethylcyclopentadienyl) iron, bis(methylcyclopentadienyl) iron, and bis(1-methyl-2-ethylcyclopentadienyl) iron. The preferred iron compounds are dicyclopentadienyl iron, and bis(methylcyclopentadienyl) iron.

Representative substituted cyclopentadienyl manganese tricarbonyl compounds are methylcyclopentadienyl manganese tricarbonyl, ethylcyclopentadienyl manganese tricarbonyl, dimethylcyclopentadienyl manganese tricarbonyl, methylethylcyclopentadienyl manganese tricarbonyl, and diethylcyclopentadienyl manganese tricarbonyl. The preferred manganese compounds are cyclopentadienyl manganese tricarbonyl and methylcyclopentadienyl manganese tricarbonyl.

The "compounds", "iron compounds", and "manganese compounds" referred to herein (for the sake of brevity) are the particular compounds heretofore described by full name.

Figure 1:
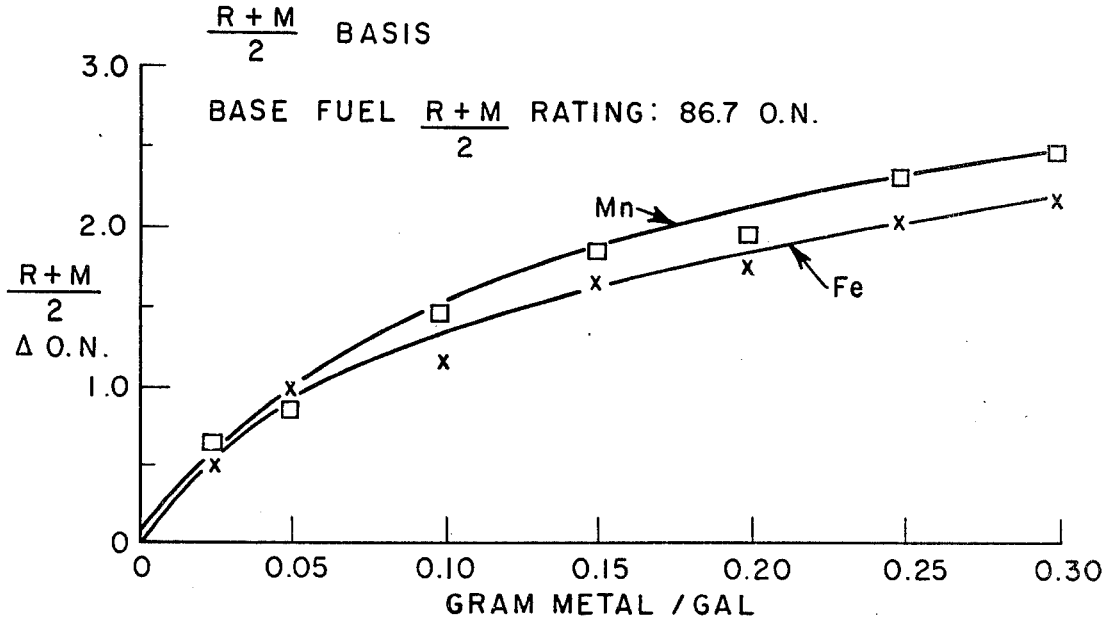
FIG. 1 is a graph depicting the improvement (ΔO.N.) in octane number over a base fuel having a research and motor average octane rating of 86.7, said improvement being effected by addition of individual iron and manganese compounds in the indicated amounts. The Figure shows that the manganese compounds are more effective octane ratings improvers than the iron compounds based on equal metal weights.

octane rating of 88.4, said improvement being effected by adding additional increments of individual manganese and iron compounds. The Figure shows a greater improvement upon addition of an iron compound (within the described weight parameters of this invention) than from addition of a manganese compound. This is surprising in view of the FIG. 1 showing that manganese compounds are more effective, alone, than are iron compounds.

DETAILS OF THE INVENTION

The hydrocarbon fuels into which the present invention combinations are incorporated consist of hydrocarbons boiling in the gasoline boiling range. Such fuels, commonly referred to as gasolines, are generally mixtures of hydrocarbons comprising paraffinic, olefinic, cycloaliphatic and aromatic hydrocarbons including such fractions and refinery products obtained by distillation, cracking, reforming, alkylation and polymerization processes. The gasoline may also contain other additives normally used in commercial gasolines.

The dicyclopentadienyl iron compounds and the cyclopentadienyl manganese tricarbonyl compounds can be added to the fuels separately or as mixtures. Since these compounds are soluble in normally liquid hydrocarbons such as gasoline, kerosene, toluene, xylene and the like, they can be added more conveniently in solution. Solution mixtures can contain about 20% to 75% by weight of the mixed metal compounds.

Normally, the iron and the manganese compounds are added in a proportion to provide about 0.05 to 0.25 gram of total metal for each gallon of gasoline, and preferably about 0.075 to 0.175 gram of total metal per gallon. The proportions of dicyclopentadienyl iron and cyclopentadienyl manganese tricarbonyl compounds used in the combinations provide about 10% to 70% by weight of iron and about 30 to 90% by weight of manganese; preferably about 15% to 60% by weight of iron and about 40% to 85% by weight of manganese in the combined weight of iron and manganese. Thus, the hydrocarbon fuels of the present invention contain about 0.005 to 0.175 gram per gallon of iron and about 0.015 to 0.225 gram per gallon of manganese; preferably about 0.01 to 0.11 gram per gallon of iron and about 0.03 to 0.15 gram per gallon of manganese.

EXAMPLES 1 TO 8 AND COMPARISONS

The following Examples illustrate the invention. The base fuel used in the Examples and Comparisons is a lead-free motor gasoline having the following characteristics:

| | |
|---|---|
| Saturated hydrocarbons, vol. percent | 61 |
| Olefinic hydrocarbons, vol. percent | 8 |
| Aromatic hydrocarbons, vol. percent | 31 |
| Distillation (ASTM D-86): | |
| | °C |
| Initial boiling point (approx.) | 38 |
| 5% | 53 |
| 10% | 62 |
| 30% | 97 |
| 50% | 122 |
| 70% | 144 |
| 90% | 179 |
| 95% | 201 |
| Max. temp. | 219 |
| Recovery vol. % | 98 |
| Residue vol. % | 1 |
| Read Vapor Pressure (ASTM D-323) lb. 7.9 | |
| Induction Period (ASTM D-525) no break (>1440 min.) | |
| Suflur (ASTM D-3120) weight percent 0.034 | |
| Octane Rating | |
| Research Octane Number | 91.4 |
| Motor Octane Number | 82.0 |
| $\frac{R+M}{2}$ Octane Number | 86.7 |

The octane numbers of the fuels were determined by the Research Method (ASTM D-909) and the Motor Method (ASTM D-357). Generally, Research Octane Number is considered to be a better guide of antiknock quality of fuels when vehicles are operated under mild conditions associated with low speeds while the Motor Octane Number is considered to be a better indicator when the operation of vehicles is at high engine speed or under heavy load conditions. Under many engine operating conditions, some intermediate value between the Research and Motor Octane Numbers, such as the average, (R+M)/2, provides the best indication of the antiknock quality of the fuels on the road.

To separate portions of the base gasoline were added dicyclopentadienyl iron and methylcyclopentadienyl manganese tricarbonyl and the combinations thereof in the amounts described in the tables below. The knock ratings for fuel blends containing a combination of antiknock compounds were duplicate ratings on duplicate samples while the knock ratings for the fuel blends containing individual antiknock compounds were duplicate ratings on single samples.

The antiknock response of the fuel to different concentrations of dicyclopentadienyl iron and methylcyclopentadienyl manganese tricarbonyl are summarized in Table 1 in terms of increase in the octane number (ΔO.N.) over Research, Motor, and (R+M)/2 Octane Numbers of the base fuel. The antiknock response of the fuel to the combinations of dicyclopentadienyl iron and methylcyclopentadienyl manganese tricarbonyl, also in terms of ΔO.N., are summarized in Table 2. For comparison, ΔO.N. for the manganese and iron compounds at the same total metal concentrations as present in the various iron and manganese combinations are also listed in Table 2. These values are either from Table 1 or are interpolated from the data presented therein.

In Tables 1 and 2, Fe is based on dicyclopentadienyl iron and Mn is based on methylcyclopentadienyl manganese tricarbonyl.

TABLE 1

| FOR COMPARISON PURPOSES | | | | |
|---|---|---|---|---|
| Fe | Mn | Increase in Octane Number (ΔO.N.) | | |
| g/gal | g/gal | Research | Motor | (R+M)/2 |
| 0.025 | — | 0.7 | 0.3 | 0.5 |
| — | 0.025 | 0.7 | 0.6 | 0.6 |
| 0.05 | — | 1.1 | 0.8 | 0.9 |
| — | 0.05 | 1.1 | 0.6 | 0.9 |
| 0.10 | — | 1.6 | 1.1 | 1.1 |
| — | 0.10 | 1.9 | 1.1 | 1.5 |
| — | 0.125 | 2.2 | 1.2 | 1.7 |
| 0.15 | — | 2.1 | 1.2 | 1.7 |
| — | 0.15 | 2.4 | 1.2 | 1.8 |
| 0.2 | — | 2.1 | 1.4 | 1.7 |
| — | 0.2 | 2.6 | 1.3 | 2.0 |
| 0.25 | — | 2.5 | 1.6 | 2.1 |
| — | 0.25 | 3.0 | 1.6 | 2.3 |
| 0.30 | — | 2.7 | 1.6 | 2.2 |
| — | 0.30 | 3.1 | 1.8 | 2.5 |

TABLE 2

| EXAMPLES ARE NUMBERED; OTHER DATA FOR COMPARISON | | | | | | |
|---|---|---|---|---|---|---|
| Example | Metal g/gal | | Total Metal | Increase in Octane Number (ΔO.N.) | | |
| No. | Mn | Fe | g/gal | Research | Motor | (R+M)/2 |
| | 0.075 | — | 0.075 | 1.5 | 0.9 | 1.2 |
| | — | 0.075 | 0.075 | 1.4 | 0.9 | 1.2 |
| 1 | 0.025 | 0.05 | 0.075 | 1.5 | 0.8 | 1.2 |
| | 0.10 | — | 0.10 | 1.9 | 1.1 | 1.4 |
| | — | 0.10 | 0.10 | 1.7 | 1.1 | 1.4 |
| 2 | 0.05 | 0.05 | 0.10 | 1.9 | 1.0 | 1.5 |
| | 0.125 | — | 0.125 | 2.2 | 1.2 | 1.7 |
| | — | 0.125 | 0.125 | 1.8 | 1.2 | 1.5 |
| 3 | 0.075 | 0.05 | 0.125 | 2.1 | 1.3 | 1.7 |
| | 0.15 | — | 0.15 | 2.4 | 1.2 | 1.8 |
| | — | 0.15 | 0.15 | 2.1 | 1.2 | 1.7 |
| 4 | 0.125 | 0.025 | 0.15 | 2.4 | 1.4 | 1.9 |
| | 0.175 | — | 0.175 | 2.5 | 1.3 | 1.9 |
| | — | 0.175 | 0.175 | 2.1 | 1.3 | 1.7 |
| 5 | 0.125 | 0.05 | 0.175 | 2.5 | 1.6 | 2.1 |
| | 0.20 | — | 0.20 | 2.7 | 1.3 | 2.0 |
| | — | 0.20 | 0.20 | 2.1 | 1.4 | 1.7 |
| 6 | 0.125 | 0.075 | 0.20 | 2.6 | 1.7 | 2.2 |
| | 0.225 | — | 0.225 | 2.8 | 1.5 | 2.1 |
| | — | 0.225 | 0.225 | 2.3 | 1.5 | 1.9 |
| 7 | 0.125 | 0.10 | 0.225 | 2.6 | 1.7 | 2.2 |
| | 0.25 | — | 0.25 | 2.9 | 1.6 | 2.3 |
| | — | 0.25 | 0.25 | 2.5 | 1.6 | 2.1 |
| 8 | 0.125 | 0.125 | 0.25 | 2.8 | 1.8 | 2.3 |
| | 0.275 | — | 0.275 | 3.0 | 1.7 | 2.4 |
| | — | 0.275 | 0.275 | 2.6 | 1.6 | 2.1 |
| | 0.125 | 0.150 | 0.275 | 2.8 | 2.0 | 2.4 |
| | 0.125 | 0.20 | 0.325 | 3.0 | 1.8 | 2.4 |

DISCUSSION OF TABLES 1 AND 2

The results summarized in Table 1 indicate that, on an equal metal weight basis, manganese (supplied as methylcyclopentadienyl manganese tricarbonyl) provides greater increase in Research and (R+M)/2 Octane Numbers than iron (as dicyclopentadienyl iron). The increases in the Motor Octane Numbers are essentially the same.

Table 2 shows that the increases in the Research Octane Numbers for the combinations of iron and manganese compounds are essentially equal to those provided by the more effective manganese compounds at the same total metal concentrations in spite of the replacement of up to 66% of the manganese by the less effective iron compound. Table 2 also shows that at total metal concentrations of about 0.275 g/gallon, (outside the invention), the increase in the Research Octane Number for the combination of manganese and iron is about that expected from the individual performance of the iron and manganese compounds.

The increases in the Motor and (R+M)/2 Octane Numbers provided by the combinations of iron and manganese compounds as shown in Table 2, are essentially equal to or greater than those provided by equivalent weights of the manganese compound. The observations that the substitution of a portion of the manganese compound by an equal metal weight of less efficient iron compound provide Motor and (R+M)/2 Octane Number increases greater than those provided by the manganese compound alone is totally unexpected.

DISCUSSION OF FIGS. 1 AND 2

Figure 2:
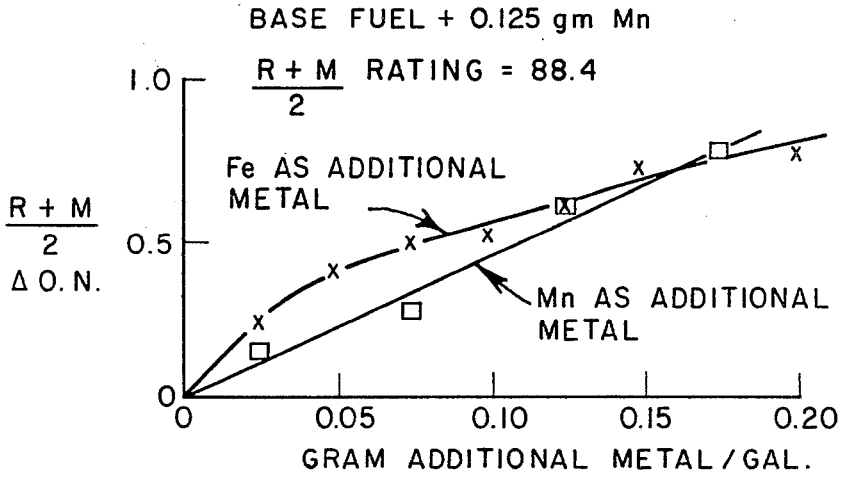
FIG. 2 is a graph depicting the improvement (ΔO.N.) in octane number over a base fuel plus 0.125 gm Mn which fuel has an average $$\left(\frac{\text{Research Octane} + \text{Motor Octane}}{2}\right)$$

The effectiveness of the present invention compositions to provide improvements in octane numbers greater than those expected from the individual performance of iron and manganese antiknocks can also be seen in FIGS. 1 and 2.

FIG. 1 graphically shows improvements in the average of the Research and Motor Octane Numbers, i.e., (R+M)/2, for methylcyclopentadienyl manganese tricarbonyl and dicyclopentadienyl iron for metal concentrations up to 0.3 g/gallon. It will be noted that (R+M)/2 octane number improvements are better for manganese than for iron on an equal metal weight basis.

FIG. 2 shows further improvements in (R+M)/2 octane number when, to the fuel containing 0.125 g/gallon of manganese, additional amounts of manganese (as methylcyclopentadienyl manganese tricarbonyl) or iron (as dicyclopentadienyl iron are added. It will be noted that for an equal weight of the metal added, greater improvements in (R+M)/2 octane numbers are obtained with iron than with manganese, up to a total metal concentration of about 0.275 g/gallon, which is slightly above the upper limit of the total metal contemplated for the invention compositions. This result is surprising because, according to FIG. 1, it would be expected that the addition of a less effective iron compound to a fuel containing manganese should provide smaller improvements than the addition of an equal metal weight of the more efficient manganese compound.

Further reference to FIG. 2 shows that to obtain an additional (R+M)/2 octane number increase of 0.25 for the fuel already containing 0.125 g/gallon manganese, will require about 0.025 g/gallon of iron but will require about 0.055 g/gallon of manganese. Thus, the efficiency of iron is some 220% greater than manganese in this situation. Similarly, to obtain an additional 0.5 (R+M)/2 octane number increase, the relative amount of iron to manganese is 0.07 g/gallon vs. 0.11 g/gallon which indicates an efficiency of 157% greater for iron vs. manganese.

The embodiments of the invention in which an exclusive property or privilege is claimed are defined as follows:

1. A lead-free hydrocarbon fuel composition consisting essentially of hydrocarbons boiling in the gasoline boiling range of about 20° C. to 225° C., having dissolved therein a combination of iron and manganese antiknock compounds in amounts to provide about 0.05 to 0.25 gram of total metal per gallon of fuel, said combination consisting essentially of about (i) 10% to 70% of iron, by weight of total metal, provided by at least one member of the group dicyclopentadienyl iron and substituted dicyclopentadienyl iron in which the substituent consists of one or two alkyl radicals of 1 or 2 carbon atoms, and (ii) 30% to 90% of manganese, by weight of total metal, provided by at least one member of the group cyclopentadienyl manganese tricarbonyl and substituted cyclopentadienyl manganese tricarbonyl in which the substituent consists of one or two alkyl radicals of 1 or 2 carbon atoms.

2. A composition according to claim 1 wherein the total metal content is about 0.075 to 0.175 gram per gallon.

3. A composition according to claim 2 wherein the iron is present at about 15% to 60% and the manganese is present at about 40% to 85% based on total weight of metal.

4. A composition according to claim 1 wherein the iron compound is selected from dicyclopentadienyl iron and bis(methylcyclopentadienyl) iron.

5. A composition according to claim 4 wherein the iron compound is dicyclopentadienyl iron.

6. A composition according to claim 1 wherein the manganese compound is selected from cyclopentadienyl manganese tricarbonyl and methylcyclopentadienyl manganese tricarbonyl.

7. A composition according to claim 6 wherein the manganese compound is methylcyclopentadienyl manganese tricarbonyl.

8. A composition according to claim 3 wherein the iron compound is dicyclopentadienyl iron and the manganese compound is methylcyclopentadienyl manganese tricarbonyl.

9. A solution in a normally liquid hydrocarbon said solution containing from 20% to 75%, by total weight of the solution, of a mixture of compounds wherein one of said compounds is a compound selected from dicyclopentadienyl iron and substituted dicyclopentadienyl iron in which the substituent consists of 1 or 2 alkyl radicals of 1 or 2 carbon atoms, and the other of said compounds is selected from cyclopentadienyl manganese tricarbonyl and substituted cyclopentadienyl manganese tricarbonyl in which the substituent consists of 1 or 2 alkyl radicals of 1 or 2 carbon atoms, said mixture of compounds consisting essentially of about 10% to 70% of said iron compound and about 30% to 90% of said manganese compound based on total weight of metal.

* * * * *